US009567814B2

(12) United States Patent
Tambs et al.

(10) Patent No.: US 9,567,814 B2
(45) Date of Patent: Feb. 14, 2017

(54) HOISTING SYSTEMS WITH HEAVE COMPENSATION

(71) Applicant: Cameron Sense AS, Kristiansand (NO)

(72) Inventors: Erling Tambs, Kristiansand (NO); Harald Langenes, Sønge (NO); Håkon F. Bergan, Kristiansand (NO); Bård H. Kaasin, Gvarv (NO)

(73) Assignee: Cameron Sense AS, Kristiansan D (NO)

( * ) Notice: Subject to any disclaimer, the term of this patent is extended or adjusted under 35 U.S.C. 154(b) by 0 days.

(21) Appl. No.: 14/304,728

(22) Filed: Jun. 13, 2014

(65) Prior Publication Data

US 2015/0361735 A1 Dec. 17, 2015

(51) Int. Cl.

| | |
|---|---|
| ***E21B 19/09*** | (2006.01) |
| ***E21B 19/04*** | (2006.01) |
| ***E21B 19/00*** | (2006.01) |
| ***B66D 1/60*** | (2006.01) |
| ***B66D 1/50*** | (2006.01) |
| ***B66D 1/52*** | (2006.01) |

(52) U.S. Cl.

CPC ..... *E21B 19/006* (2013.01); *B66D 1/50* (2013.01); *B66D 1/52* (2013.01); *E21B 19/09* (2013.01)

(58) Field of Classification Search

None

See application file for complete search history.

(56) References Cited

U.S. PATENT DOCUMENTS

| | | | | |
|---|---|---|---|---|
| 5,894,895 | A * | 4/1999 | Welsh | B66C 13/02 175/40 |
| 6,926,103 | B1 * | 8/2005 | Roodenburg et al. | 175/203 |
| 6,926,260 | B1 * | 8/2005 | De Groot | B66D 3/043 254/277 |
| 7,231,981 | B2 * | 6/2007 | Moe | E21B 19/09 166/352 |
| 7,934,561 | B2 * | 5/2011 | Ormond | E21B 19/006 114/264 |
| 9,056,751 | B2 * | 6/2015 | Roodenburg | E21B 19/02 |
| 9,140,079 | B2 * | 9/2015 | Pohner | E21B 19/09 |
| 2011/0036085 | A1 | 2/2011 | Oigarden | |
| 2012/0034061 | A1 | 2/2012 | Boroy | |

FOREIGN PATENT DOCUMENTS

| | | | |
|---|---|---|---|
| CN | 102943636 | A | 2/2013 |
| CN | 203476248 | U | 3/2014 |
| CN | 102691484 | B | 4/2014 |
| WO | 2013/076207 | A2 | 5/2013 |
| WO | 2015007412 | | 1/2015 |

* cited by examiner

*Primary Examiner* — Matthew R Buck
*Assistant Examiner* — Douglas S Wood
(74) *Attorney, Agent, or Firm* — Eubanks PLLC

(57) ABSTRACT

Various hoisting systems with heave compensation are provided. In one embodiment, an apparatus includes a hoisting system having a crown block and a drawworks. The drawworks includes a rotatable drum for reeling in and reeling out a hoisting line that is wound on the rotatable drum and reeved over the crown block. The hoisting system includes active heave control at the drawworks and a passive heave compensation system. Additional systems, devices, and methods are also disclosed.

19 Claims, 2 Drawing Sheets

HOISTING SYSTEMS WITH HEAVE COMPENSATION

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource.

Floating drilling platforms are sometimes used for offshore drilling operations and include a hoisting system for raising and lowering equipment, such as a drill string, to a subsea wellsite. Because these platforms float at the surface of the water and are not anchored to the seabed with legs, the platforms can vertically rise and fall (i.e., heave) with waves in the water. Heave compensation can be used to counteract the vertical heaving motion and reduce movement of the drill string or other hoisted load with respect to the seabed.

Various types of heave compensators have been used in an effort to maintain a constant weight on bit for a hoisted drill string and reduce deviation of the drill string with respect to the seabed as the drilling platform rises and falls with the waves. Simple heave compensators acting as shock absorbers have been provided between traveling blocks and drill strings hoisted with a drawworks system. Active heave compensation has also been used, in which heaving motion of the drilling platform is measured and used to actively control the position of the drill string.

As operators have moved to deeper waters and deeper wells, the weight of the equipment to be hoisted by offshore rigs (e.g., drill strings, casing strings, and wellhead equipment) has increased. Multi-part block-and-tackle arrangements have been used with drawworks for hoisting on drilling rigs, in which hoisting lines are reeved through sheaves of crown and traveling blocks to provide a mechanical advantage. One approach to increasing the hoisting capabilities of such arrangements is to add more lines and sheaves and increase the size of the hoisting lines. Drilling platforms have also been provided as hydraulically driven "cylinder rigs," which use large hydraulic cylinders instead of drawworks. The hydraulic cylinders in such rigs can provide both the main hoisting function and a heave compensating function.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to hoisting systems having heave compensation functions. In certain embodiments, hoisting systems include both active heave compensation at drawworks (or winches) of the systems and passive heave compensation. Further, some of the hoisting systems described below have single-part lines reeved over a crown block without any mechanical advantage from a multi-part block-and-tackle reeving.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
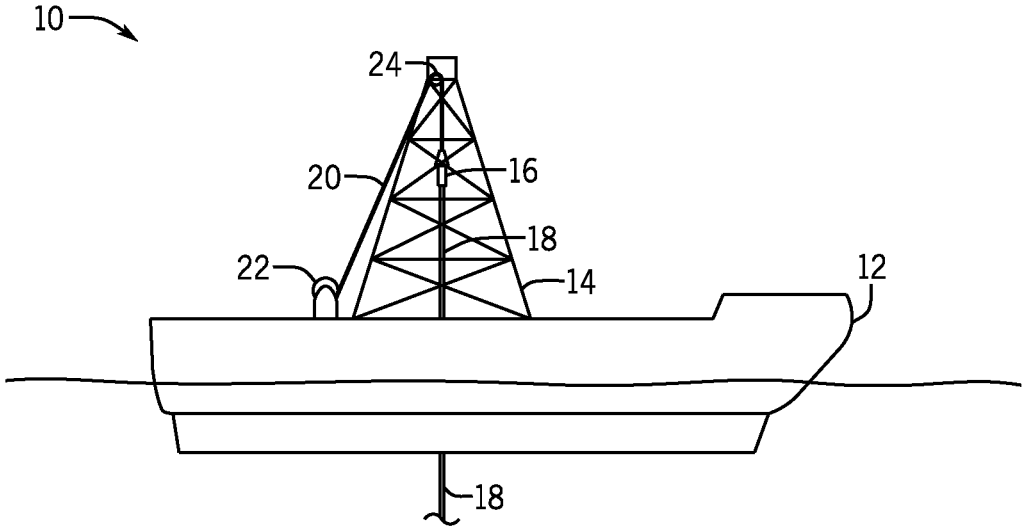
FIG. 1 generally depicts a floating drilling rig with a hoisting system in accordance with one embodiment of the present disclosure.

Turning now to the present figures, a system 10 is illustrated in FIG. 1 in accordance with one embodiment. In this example, the system 10 is an offshore drilling rig in the form of a floating vessel 12. More specifically, the floating vessel 12 is generally depicted as a drillship in FIG. 1, but the floating vessel could be provided in another form, such as a semi-submersible drilling rig, in other embodiments.

The vessel 12 includes a hoisting system for raising and lowering equipment with respect to a drill floor of the vessel, which facilitates well drilling and completion operations. The depicted hoisting system includes a derrick 14 constructed on the drill floor of the vessel 12. Various equipment and other loads can be supported by one or more hoisting lines 20 of the hoisting system. In FIG. 1, the supported load includes a top drive 16 and a drill string 18 suspended from the top drive 16. The drill string 18 extends through a hole in the drill floor of the vessel 12 and can be rotated by the top drive 16 to facilitate drilling of a subsea well. It will be appreciated that the hoisting system could be used for hoisting other loads, such as casing strings, wellhead equipment, and other subsea well components.

The hoisting system includes a drawworks 22, which can be provided on the drill floor with the derrick 14, as shown in FIG. 1, or at another location. The drawworks 22 includes a rotatable drum 26 (FIG. 2) that can reel in and reel out the hoisting line (or lines) 20 wound on the rotatable drum. Each hoisting line 20 can be reeved over a sheave in a crown block 24 coupled to the derrick 14 and connected to the supported load so that the reeling in and reeling out of the hoisting line 20 via the drum 26 raises and lowers the supported load.

Figure 2:
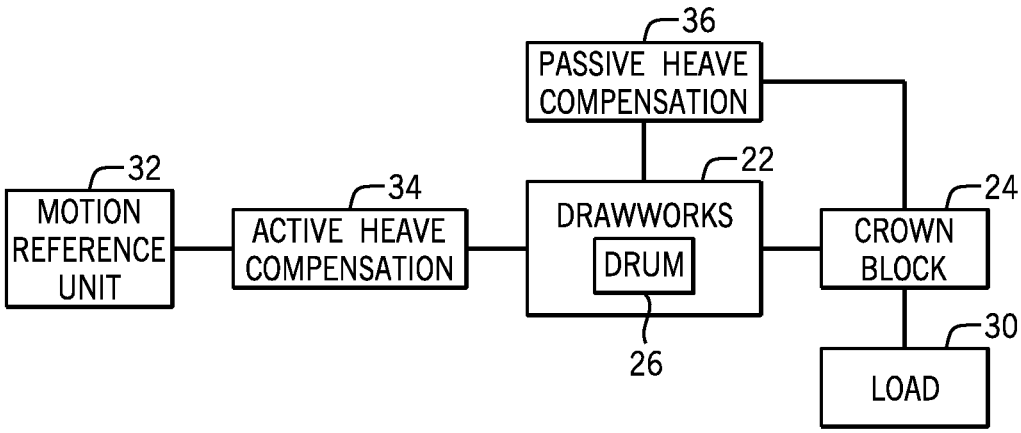
FIG. 2 is a block diagram representing a hoisting system having both active and passive heave compensation functions in accordance with one embodiment.

In at least some embodiments, the hoisting system includes both active heave compensation and passive heave compensation to compensate for heaving motion of the floating vessel 12 from wave action at the surface of the water. One such embodiment is generally depicted in FIG. 2 by way of example. In this figure, a load 30 is supported by a hoisting system including the crown block 24 and the drawworks 22 with the rotatable drum 26. As described above, one or more hoisting lines 20 can be wound from the drum 26 and reeved over the crown block 24 to support a given load 30. Although not depicted here, it is noted that the hoisting lines 20 can be coupled to the load 30 by a traveling block suspended from the crown block 24 with the hoisting lines 20. But the traveling block is omitted in some embodiments.

As the load 30 is suspended from the crown block 24 with the hoisting lines 20, heave of the vessel 12 causes the load 30 to move up and down with respect to the underlying seabed. During drilling operations, such movement can cause a drill bit at the end of the drill string 18 to be pulled off the bottom of the well (with upward heave) or to be pushed with greater force against the bottom if the well (with downward heave).

To compensate for the heaving motion and reduce deviation of the hoisted load 30 with respect to the seabed, the hoisting system in FIG. 2 includes an active heave compensation system 34 and a passive heave compensation system 36. A motion reference unit 32 can be used to detect the heave of the vessel 12. In at least some embodiments, the active heave compensation system 34 uses the measured heave to actively compensate for heaving motion through control of the drawworks 22. For instance, the active heave compensation system 34 can include a controller (e.g., a programmable logic controller or a programmed general-purpose computer) that receives the measured heave as an input and controls operation of the drawworks 22 to raise and lower the load 30 (with respect to the drill floor) to compensate for the heaving motion. The controller can control operation in any suitable manner, such as by sending command signals to motors of the drawworks 22 that control rotation of the drum 26. These motors can be considered part of the active heave compensation system 34 as well.

The passive heave compensation system 36 can also be used to counter heaving motion of the vessel 12. In contrast to the active heave compensation system 34, the passive heave compensation system 36 can counter heave without requiring external power. For example, the passive heave compensation system 36 can include one or more hydraulic devices (e.g., hydraulic cylinders or hydraulic motors) that passively store and release energy from the heaving motion of the vessel 12 to move the load 30 with respect to the drill floor to reduce the deviation of the load 30 from its position with respect to the seabed. In some instances, the passive heave compensation system 36 could also include an active component (e.g., a hydraulic cylinder that passively compensates for heave and that can also be actively driven for further heave compensation).

Figure 7:
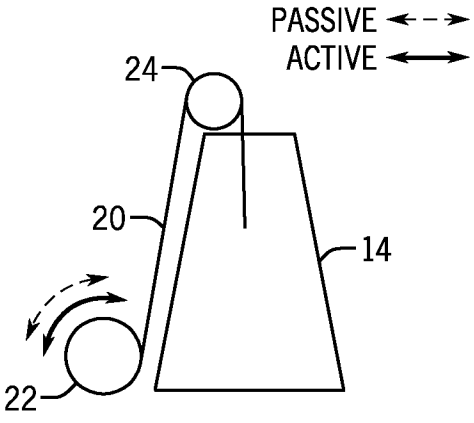

Various examples of hoisting systems having both active and passive heave compensation are generally depicted in FIGS. 3-7 in accordance with certain embodiments. In each of these examples, the hoisting system includes a drawworks 22 with active heave compensation applied by rotating the drawworks drum, such as described above. The drum 26 of the drawworks 22 can be driven in any suitable manner, such as by electric or hydraulic motors. In those hoisting systems depicted in FIGS. 3-6, which are described in additional detail below, passive heave compensation is provided by hydraulic cylinders that are used to move sheaves in the hoisting system to counter heaving motion of the floating vessel 12. But hydraulic motors or other devices could also or instead be used for passive heave compensation. Additionally, the passive heave compensation devices in some instances include an active component as well, such as a hydraulic cylinder that passively compensates for heave but can also be selectively driven by equipment on the vessel 12 to actively compensate for heave. In FIG. 7, also described further below, a hoisting system is shown as having passive heave compensation that rotates the drawworks drum 26 along with the active heave compensation. While a single hoisting line 20 is depicted in each of FIGS. 3-7, it is noted that the hoisting systems represented in these figures could use multiple hoisting lines 20, and that additional elements (e.g., hydraulic cylinders for passive heave compensation) can be added for use with the additional hoisting lines 20.

As noted above, one approach to increasing hoisting capacity of a hoisting system is to increase the number and size of the hoisting lines. The hoisting lines can also be reeved between additional sheaves in the crown block and the traveling block to increase the number of parts in the lines that run between the crown block and the traveling block to increase the mechanical advantage. But a drawback to this approach is that it adds friction to the system and reduces the traveling speed of the hoisted load relative to the rotational speed of a drawworks drum. The added friction is amplified in an active heave compensating drawworks, negatively affecting the goal of achieving a constant weight-on-bit during heaving motion of a drilling vessel. By way of example, typical 1000-ton or 1250-ton hoisting systems can have multi-part hoisting lines with sixteen parts in a block-and-tackle reeving and sixteen or seventeen sheaves, and use a two-inch diameter wire rope. Such systems can have losses of approximately 15% or 20% due to the reeving efficiencies alone. Further accounting for the inertia effects of the rotating systems and the high speed of the hoisting lines, the overall efficiency of such approaches can be around 55%.

Certain embodiments of the present technique, however, include a hoisting system using one or more single-part hoisting lines to reduce the friction and inertia effects associated with the conventional approach of adding sheaves and increasing the number of parts of the line in the reeving to increase the mechanical advantage. It is noted that FIGS. 3-5 and 7 depict such single-part hoisting line arrangements, while FIG. 6 depicts a multi-part hoisting line arrangement. In one embodiment a 1500-ton hoisting system using a drawworks with a single-part hoisting line, with no mechanical advantage from multi-part block-and-tackle reeving, is estimated to have lower friction losses (e.g., approximately 30% lower) compared to a conventional drawworks of the same capacity. This reduction may be of particular use in an active heave compensating system where high line speed and accelerations may often occur to compensate for heaving motion of the floating vessel 12. In addition to the efficiencies discussed above, the single-part hoisting system can eliminate the cut-and-slip procedures periodically required for conventional multi-part block-and-tackle reeving systems. Further, multiple single-part lines 20 can be wound from the drawworks 22 and used to suspend the load 30 so that there is no single point of failure that would allow the load 30 to drop from a broken line 20. In some embodiments, the single-part reeving can include one or more wire ropes connected directly to a live top drive load 30 and anchored to the rotating drawworks drum 26.

The embodiments described below are examples of how both active and passive heave compensation can be provided in a hoisting system. The particular design chosen for a given application can depend on numerous factors or desires, such as lowest center of gravity, reduction or elimination of multi-part reeving, ease of installation and maintenance, performance scalability, and reduction in friction and hysteresis.

Figure 4:
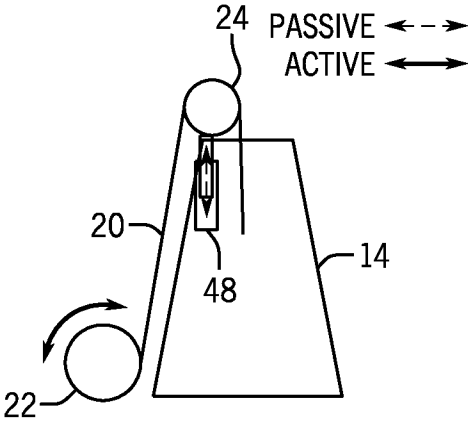
Figure 3:
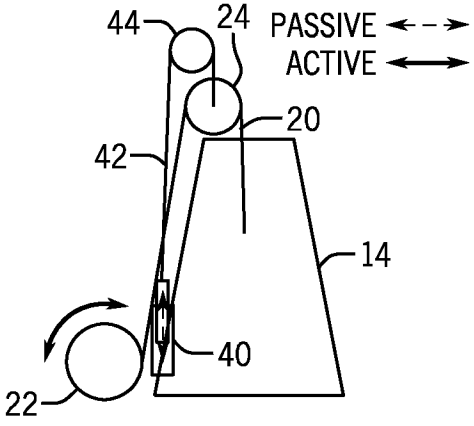

In FIGS. 3 and 4, each of the depicted hoisting systems include active heave control on a drawworks 22 (e.g., electric motors coupled to the rotating drum 26 of the drawworks 22) and a single-part line 20 reeved over the crown block 24 from the drawworks 22. As noted above, the single-part line 20 can be coupled to the load 30 (e.g., top drive 16 and attached drill string 18 or casing string). In the hoisting system of FIG. 3, the passive heave compensation system includes a hydraulic cylinder 40 connected to the crown block 24 with a tension line 42 passed over a stationary turning sheave 44 suspended above the crown block 24. The crown block 24 is allowed to travel vertically with respect to the turning sheave 44 in response to operation of the hydraulic cylinder 40. In the case of multiple single-part hoisting lines, multiple hydraulic cylinders 40, tension lines 42, and turning sheaves 44 can also be used. The hydraulic cylinders 40 can be located at the drill floor level with the drawworks 22, rather than positioned high in the derrick 14 (e.g., near the crown block 20). In FIG. 4, the hoisting system includes a hydraulic cylinder 48 mounted high in the derrick 14 with the crown block 24. The crown block 24 in this embodiment is directly connected (without a tension line 42) to the hydraulic cylinder 48 and allowed to move vertically in response to heave.

Figure 5:
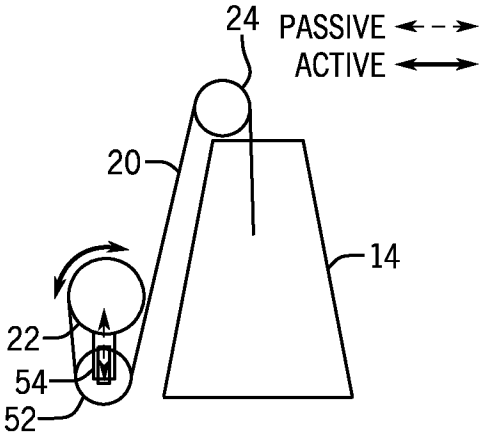
FIGS. 3-7 show examples of hoisting systems having active and passive heave compensation in accordance with various embodiments.
Figure 6:
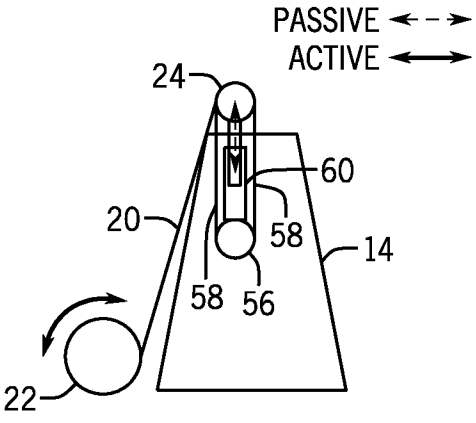

In FIG. 5, the hoisting system includes the hoisting line 20, the drawworks 22 with active heave compensation, a fixed crown block 24, and a passive heave compensation system including a sheave 52 and a hydraulic cylinder 54. The hoisting line 20 extends from the drawworks 22 and is reeved about the sheave 52 and over the crown block 24. The hydraulic cylinder 54 is mounted below the drawworks 22 and coupled to the sheave 52, allowing the sheave 52 to move with respect to the drawworks 22 to compensate for heaving motion of the floating vessel 12.

The hoisting system of FIG. 6 includes the drawworks 22 with active heave compensation and a hoisting line 20 reeved between the crown block 24 and a traveling block 56 for supporting the load 30. The hoisting line 20 can be reeved as a two-part line, as presently shown (with parts 58 running between the crown block 24 and the traveling block 56). In other embodiments, the line 20 can be reeved with more than two parts, such as in a four-part line arrangement. Passive heave compensation is provided by a hydraulic cylinder 60 coupled to act on the crown block 24.

In FIG. 7, active and passive heave compensation are both applied via the drawworks 22. In some embodiments, the active heave compensation can be provided via electric motors driving rotation of the drum 26 of the drawworks 22 and the passive heave compensation can be provided by a hydraulic component, such as a hydraulic cylinder or motor. Additional examples of hoisting systems having drawworks or winches with both active and passive heave control are described in U.S. patent application Ser. No. 14/304,748, which was filed on Jun. 13, 2014, and at the time of filing was entitled "Heave Compensation Winches," named Håkon E Bergan et al. as inventors, that application is hereby incorporated by reference in its entirety.

Though all-hydraulic cylinder rigs can be used for hoisting functions, they can have certain drawbacks, such as the complexity of the hydraulics, the size and expense of a hydraulic power unit sufficient for the rig, and the piping and cylinders required to provide both the main hoisting function (which may require about 180 feet of vertical travel) and the heave compensating system. In contrast, certain embodiments disclosed herein include an electrically driven winch or drawworks for normal hoisting functions and active heave compensation combined with a hydraulic passive heave compensating system with much less complexity than the all-hydraulic designs. This reduction in complexity enables lighter hoisting systems to be used and facilitates installation and servicing. The present systems may also have reduced power consumption compared to certain previous designs. Further, moving the passive heave compensation system to the drill floor from high in the derrick provides a lower center of gravity. And in the use of single-part lines in some embodiments enables a faster hoisting speed while maintaining a reasonable rotation speed of the drum of the winch.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An apparatus comprising:

a hoisting system including:

a crown block; and a drawworks having a rotatable drum for reeling in and reeling out a hoisting line wound on the rotatable drum and reeved over the crown block;

wherein the hoisting system includes both active heave control via the drawworks and a passive heave compensation system, and wherein the passive heave compensation system is coupled to the drawworks in a manner that allows the passive heave compensation system to operate via rotation of the rotatable drum.

2. The apparatus of claim 1, comprising the hoisting line.

3. The apparatus of claim 2, wherein the hoisting line is reeved over the crown block and arranged as a single-part line.

4. The apparatus of claim 3, wherein the crown block is a traveling crown block and the passive heave compensation system includes a hydraulic cylinder coupled to directly act on the traveling crown block in response to heave of a floating drilling vessel having the hoisting system.

5. The apparatus of claim 2, comprising a traveling block suspended from the crown block via the hoisting line.

6. The apparatus of claim 5, wherein the hoisting line is reeved between the crown block and the traveling block in a two-part line arrangement.

7. The apparatus of claim 5, wherein the passive heave compensation system includes a hydraulic cylinder coupled to the crown block.

8. An apparatus comprising:

a hoisting system including:

a crown block; and a drawworks having a rotatable drum for reeling in and reeling out a hoisting line wound on the rotatable drum and reeved over the crown block; and the hoisting line, wherein the hoisting line is reeved over the crown block and arranged as a single-part line;

wherein the hoisting system includes both active heave control via the drawworks and a passive heave compensation system, the crown block is a traveling crown block, and the passive heave compensation system includes a hydraulic cylinder coupled to the traveling crown block by a tension line reeved over a sheave suspended above the traveling crown block.

9. The apparatus of claim 8, wherein the hydraulic cylinder and the drawworks are located at a drill floor level of a floating drilling vessel.

10. The apparatus of claim 8, wherein the hoisting system does not include a traveling block suspended from the crown block.

11. The apparatus of claim 8, comprising a floating vessel having the hoisting system.

12. The apparatus of claim 11, wherein the floating vessel is a drillship.

13. An apparatus comprising:

a hoisting system including:

a crown block;

a drawworks having a rotatable drum for reeling in and reeling out a hoisting line wound on the rotatable drum and reeved over the crown block; and the hoisting line, wherein the hoisting line is reeved over the crown block and arranged as a single-part line;

wherein the hoisting system includes both active heave control via the drawworks and a passive heave compensation system, and wherein the passive heave compensation system includes a hydraulic cylinder coupled to the drawworks and to a sheave, with the hoisting line extending from the drawworks reeved about the sheave and over the crown block.

14. The apparatus of claim 13, wherein the hoisting system does not include a traveling block suspended from the crown block.

15. The apparatus of claim 13, comprising a floating vessel having the hoisting system.

16. The apparatus of claim 15, wherein the floating vessel is a drillship.

17. A method comprising:

connecting a load to a hoisting system of a floating vessel;

using the hoisting system to position the load;

detecting heave of the floating vessel;

applying active heave compensation to a drawworks of the hoisting system based on the detected heave to reduce relative movement of the load with respect to a seabed below the floating vessel due to the heave; and applying passive heave compensation to the hoisting system to reduce relative movement of the load with respect to the seabed due to the heave;

wherein both the active heave compensation and the passive heave compensation is applied to the drawworks of the hoisting system.

18. The method of claim 17, comprising reeving one or more hoisting lines over a crown block of the hoisting system such that the one or more hoisting lines are arranged as single-part lines for collectively supporting the weight of the load.

19. The method of claim 17, wherein connecting the load to the hoisting system includes connecting a top drive to the hoisting system.

* * * * *